US007886668B2

(12) United States Patent
Hugus et al.

(10) Patent No.: US 7,886,668 B2
(45) Date of Patent: Feb. 15, 2011

(54) METAL MATRIX COMPOSITE ENERGETIC STRUCTURES

(75) Inventors: George D. Hugus, Chuluota, FL (US); Edward W. Sheridan, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1206 days.

(21) Appl. No.: 11/447,068

(22) Filed: Jun. 6, 2006

(65) Prior Publication Data

US 2007/0277914 A1 Dec. 6, 2007

(51) Int. Cl.
*F42B 12/02* (2006.01)
*F42B 12/72* (2006.01)
*F42B 12/76* (2006.01)

(52) U.S. Cl. ..... 102/517; 102/516; 102/473; 102/519

(58) Field of Classification Search ..... 102/473, 102/476, 501, 517, 519, 516; 149/14, 15, 149/17, 20

See application file for complete search history.

(56) References Cited

U.S. PATENT DOCUMENTS 1,367,846 A 2/1921 Washburn
1,399,953 A 12/1921 Fulton
2,200,742 A 5/1940 Hardy
2,200,743 A 5/1940 Hardy
3,056,255 A 10/1962 Thomsen
3,254,996 A 6/1966 MacDonald
3,325,316 A 6/1967 MacDonald
3,344,210 A 9/1967 Silvia
3,362,859 A 1/1968 Sutton
3,422,880 A 1/1969 Brown et al.
3,433,196 A 3/1969 Sjoblom
3,437,534 A 4/1969 McEwan et al.
3,596,602 A 8/1971 Gey et al.
3,632,458 A 1/1972 Filter et al.
3,661,083 A 5/1972 Weinholt
3,831,520 A 8/1974 Bowen et al.
3,961,576 A 6/1976 Montgomery, Jr.
4,129,465 A 12/1978 Johnson et al.
4,757,764 A 7/1988 Thureson et al.
4,933,241 A 6/1990 Holt et al.
4,996,922 A 3/1991 Halcomb et al.
5,000,093 A * 3/1991 Rozner et al. ..... 102/364

(Continued)

FOREIGN PATENT DOCUMENTS

EP 1 348 683 10/2003

(Continued)

OTHER PUBLICATIONS

Partial European Search Report dated Oct. 23, 2007.

(Continued)

*Primary Examiner*—James S Bergin
(74) *Attorney, Agent, or Firm*—Buchanan Ingersoll & Rooney PC

(57) ABSTRACT

A munition includes a structural component formed from a composite material comprising a energetic material dispersed in a metallic binder material. A method is also provided that includes forming a energetic material, combining the energetic material with a metallic binder material to form a mixture, and shaping the mixture to form a composite structural munition component.

12 Claims, 3 Drawing Sheets

U.S. PATENT DOCUMENTS

| | | | | |
|---|---|---|---|---|
| 5,090,322 | A | 2/1992 | Allford | |
| 5,392,713 | A | 2/1995 | Brown et al. | |
| 5,401,340 | A | 3/1995 | Doll et al. | |
| 5,429,691 | A | 7/1995 | Hinshaw et al. | |
| 5,439,537 | A | 8/1995 | Hinshaw et al. | |
| 5,505,799 | A | 4/1996 | Makowiecki | |
| 5,509,357 | A | 4/1996 | Lawther | |
| 5,538,795 | A | 7/1996 | Barbee, Jr. et al. | |
| 5,544,589 | A | 8/1996 | Held | |
| 5,547,715 | A | 8/1996 | Barbee, Jr. et al. | |
| 5,567,908 | A * | 10/1996 | Mc Cubbin et al. | 102/519 |
| 5,700,974 | A | 12/1997 | Taylor | |
| 5,717,159 | A | 2/1998 | Dixon et al. | |
| 5,732,634 | A | 3/1998 | Flickinger et al. | |
| 5,773,748 | A | 6/1998 | Makowiecki et al. | |
| 5,852,256 | A * | 12/1998 | Hornig | 102/473 |
| 5,912,069 | A | 6/1999 | Yializis et al. | |
| 5,936,184 | A | 8/1999 | Majerus et al. | |
| 6,276,276 | B1 | 8/2001 | Erickson | |
| 6,276,277 | B1 | 8/2001 | Schmacker | |
| 6,382,105 | B1 | 5/2002 | Jones | |
| 6,443,789 | B2 | 9/2002 | Tominetti et al. | |
| 6,494,140 | B1 | 12/2002 | Webster | |
| 6,597,850 | B2 | 7/2003 | Andrieu et al. | |
| 6,627,013 | B2 | 9/2003 | Carter, Jr. et al. | |
| 6,679,960 | B2 * | 1/2004 | Jones | 149/19.3 |
| 6,682,281 | B1 | 1/2004 | Larsen | |
| 6,682,817 | B1 | 1/2004 | della Porta et al. | |
| 6,713,177 | B2 | 3/2004 | George et al. | |
| 6,720,204 | B2 | 4/2004 | Sudijono et al. | |
| 6,736,942 | B2 | 5/2004 | Weihs et al. | |
| 6,843,868 | B1 | 1/2005 | Fawis et al. | |
| 6,846,372 | B1 | 1/2005 | Guirguis | |
| 6,863,992 | B2 | 3/2005 | Weihs et al. | |
| 6,962,634 | B2 | 11/2005 | Nielson et al. | |
| 6,991,860 | B2 | 1/2006 | Phillips et al. | |
| 7,191,709 | B2 | 3/2007 | Nechitailo | |
| 7,278,354 | B1 * | 10/2007 | Langan et al. | 102/306 |
| 7,383,775 | B1 | 6/2008 | Mock et al. | |
| 2001/0046597 | A1 | 11/2001 | Weihs et al. | |
| 2002/0069944 | A1 | 6/2002 | Weihs et al. | |
| 2003/0037692 | A1 | 2/2003 | Liu | |
| 2003/0164289 | A1 | 9/2003 | Weihs et al. | |
| 2003/0203105 | A1 | 10/2003 | Porta et al. | |
| 2004/0060625 | A1 | 4/2004 | Barbee, Jr. et al. | |
| 2004/0101686 | A1 | 5/2004 | Porta et al. | |
| 2004/0151845 | A1 | 8/2004 | Nguyen et al. | |
| 2004/0244889 | A1 | 12/2004 | Sailor et al. | |
| 2005/0002856 | A1 | 1/2005 | Zaluska et al. | |
| 2005/0011395 | A1 | 1/2005 | Langan et al. | |
| 2005/0100756 | A1 | 5/2005 | Langan et al. | |
| 2005/0126783 | A1 | 6/2005 | Grattan et al. | |
| 2005/0142495 | A1 | 6/2005 | Van Heerden et al. | |
| 2005/0183618 | A1 | 8/2005 | Nechitalio | |
| 2005/0189050 | A1 | 9/2005 | Sheridan | |
| 2005/0199323 | A1 | 9/2005 | Nielson et al. | |
| 2005/0235862 | A1 | 10/2005 | Gousman et al. | |
| 2007/0169862 | A1 | 7/2007 | Hugus et al. | |
| 2007/0272112 | A1 | 11/2007 | Nielson et al. | |
| 2008/0035007 | A1 * | 2/2008 | Nielson et al. | 102/517 |

FOREIGN PATENT DOCUMENTS

| | | |
|---|---|---|
| EP | 1 659 359 | 5/2006 |
| FR | 1585162 A * | 1/1970 |
| FR | 2867469 A1 * | 9/2005 |
| GB | 1 507 119 | 4/1978 |
| GB | 2 412 116 | 4/1993 |
| GB | 2 412 116 | 9/2005 |
| WO | WO 02/16128 | 2/2002 |

OTHER PUBLICATIONS

James Ertic McDonough, "Thermodynamic and Kinetic Studies of Ligand Binding, Oxidative Addition, and Group/Atom Transfer in Group VI Metal Complexes": Dec. 2005, pp. 108-149.

S,H, Fischer and M.C. Grubelich, "A Survey of Combustible Metals, Thermites, and Intermetallics for Pyrotechnic Applications," American Institute of Aeronautics and Astronautics, Inc. AIAA Meeting Papers on Disc, Jul. 1996, pp. 1-13.

L.Q. Shi et al., "Investigation of the Hydrogenation Properties of Zr Films Under Unclean Plasma Conditions," J. Vac. Sci. Tevhnol. A 20(6), Nov./Dec. 2002, pp. 1840-1845, American Vacuum Society.

Seman, Michael et al., "Investigation of the role of plasma conditions on the deposition rate and electrochromic performance of tungsten oxide thin films", J. Mac. Sci. Technol., A21(6), Nov./Dec. 2003, pp. 1927-1933.

J. Grant, editor, Hackh's Chemical Dictionary, third edition, McGraw-Hill Book Company, Inc., New York 1944.

R.J. Lewis, Sr., editor, Hawley's Condensed Chemical Dictionary, 12th edition, Vn Nostrand Reinhold Co., New York, 1993, excerpt, p. 1139.

H. Bennett, editor, Concise Chemical Dictionary, third enlarged edition, Chemical Publishing Company, Inc., New York, NY 1974, excerpt p. 1037.

Webster's Ninth New Collegiate Dictionary, Merriam-Webster's Inc., publishers; Springfield, Massachusetts, USA, 1990, excerpt p. 1224.

Boyd, J.M., "Thin-Film Electric Initiator. III. Application of Explosives and Performance Tests", U.S. Army Material Command, Harry Diamond Laboratories, Washington, DC 20438, Report No. -HDL_TR-1414, (Jan. 1969), 28.

* cited by examiner

METAL MATRIX COMPOSITE ENERGETIC STRUCTURES

FIELD OF THE DISCLOSURE

The present disclosure relates to energetic compositions for structural components of munitions. More specifically, the present disclosure relates to structural components based, at least in part, on reactive energetic materials dispersed in a metallic matrix.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art.

In order to maximize the destructive energy into a target, two common approaches are employed. The first approach involves the delivery of kinetic energy to a target by utilizing relatively high velocity munitions, thereby capitalizing on the sensitivity of kinetic energy ($E_k$) to mass (m), and especially velocity (V), as manifested by the following equation:

$$E_k = mV^2/2$$

The second approach is to optimize the storage, and timely release, of potential energy (in the form of unreacted chemical energy) contained in a payload or fill material. This release of potential energy can be expressed by reference to the first law of thermodynamics, as represented in the following equation:

$$dU = Q - W$$

where dU is the change of internal energy of the warhead payload or fill material due to release of chemical energy, Q is the heat produced by the release of chemical energy, and W is the mechanical work done by the release of chemical energy.

It is widely accepted that the probability of target destruction is enhanced by increasing the energy delivered into the target. However, the choice between utilizing kinetic energy, chemical energy, or combination of both, to achieve the desired degree of lethality is mainly driven by the anticipated target set. For example, the kinetic energy of a bomb or missile would be equivalent to its mass at impact, multiplied by the square of its impact velocity, divided by two. The corresponding release of potential energy, thereof, for either of these munitions would be the enthalpy (heat) produced by the reacted warhead fill plus the mechanical work performed by the reacted warhead fill on any working fluid involved in the event. Both kinetic energy and released chemical energy is dissipated into a target and can be added numerically, with their sum representing the total delivered energy. In the case of bombs, the impact velocity is limited by kinematics and aerodynamic laws. The impact velocity of missiles is governed by the propulsion design and aerodynamic laws. In either case, the velocity is not easily increased to such an extent that the total deliverable lethality by the munition is substantially improved. Moreover, attempts to increase the velocity of the munition often involves trade-offs in other areas which may have detrimental impacts on the overall effectiveness and/or operation of the weapon system.

Certain energetic materials have been employed that are based on a mixture of reactive metal powders and an oxidizer suspended in an organic matrix. However, there are engineering challenges presented by such reactive materials. For example, a minimum requisite activation energy must be transferred to the reactive materials in order to trigger the release of chemical energy. There has been a general lack of confidence in the ignition of such materials upon impact at velocities less than about 4000 ft/s. In addition, since the above-mentioned materials are based on organic or polymeric matrix materials, which has a density less than that of most targets, i.e., steel, further acting to the detriment of penetration capabilities. Finally, components formed from such materials must possess a certain amount of structural integrity in order to afford proper functioning of the munition or munitions systems. For example, components formed from such materials must be able to if survive shocks encountered upon launch of the munition. Polymeric matrix material often lacks the above-mentioned reactive fragments may not possess the desired degree of structural integrity.

Thus, it would be advantageous to provide an improved reactive fragment which may address one or more of the above-mentioned concerns. Related publications include U.S. Pat. Nos. 3,961,576; 4,996,922; 5,700,974; 5,912,069; 5,936,184; 6,276,277; 6,627,013; and 6,679,960, the entire disclosure of each of these publications is incorporated herein by reference.

SUMMARY OF THE INVENTION

According to the present invention, there is provided a munition which possesses one or more of: improved control of ballistic, thermal, structural and density characteristics, and in particular, a munition capable of delivering a significantly greater amount of total energy to the target.

According to the present invention there is provided a munition comprising a structural component formed from a composite material comprising a reactive energetic material dispersed in a metallic binder material.

According to another aspect, there is provided a method comprising forming a reactive energetic material, combining the reactive energetic material with a metallic binder material to form a mixture, and shaping the mixture to form a composite structural munition component.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
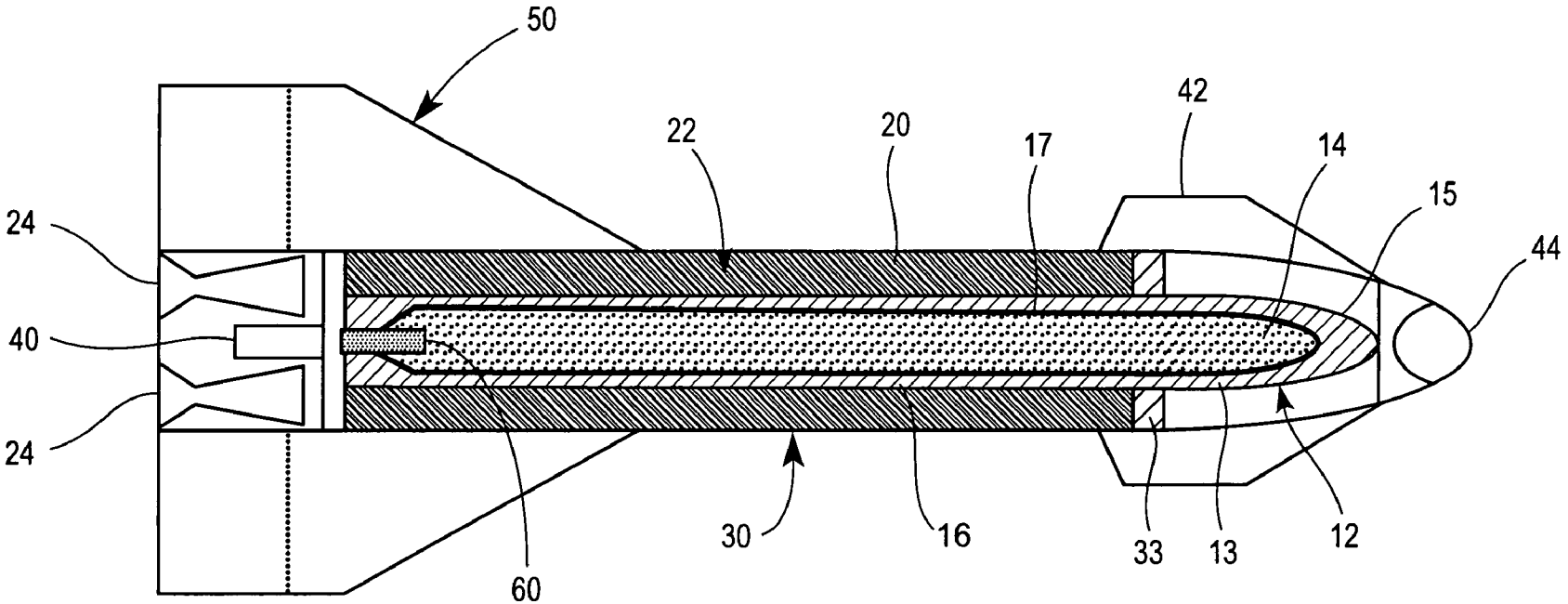
FIG. 1 is a sectional view of a munition formed according to the principles of the present invention.

FIG. 1 illustrates a munition formed according to the principles of the present invention, and according to one embodiment thereof. The munition illustrated in FIG. 1 is in the form of a boosted penetrating bomb. The munition includes a penetrator 12 comprising a casing 13, as well as containing a payload 14, preferably in the form of an explosive medium. Optionally, a shaped charge liner or casing insert 17 may be provided within the casing 13. Other payloads may be used or included, for example, fragmenting bomblets, chemicals, incendiaries, and/or radioactive material. A rocket booster motor 20 for accelerating the penetrator 12 includes an annular fuel chamber 22 and a plurality of exhaust nozzles 24. The annular chamber 22 defines a central interior space in which the penetrator 12 is mounted.

An outer skin or shroud 30 encloses at least portions of the booster motor 20 and the penetrator 12, and provides an aerodynamic shape. The mounting structure holding the penetrator 12 to the rocket booster motor 20 and the shroud 30 must be capable of supporting the penetrator 12, especially during the boost phase (when the rocket is firing), but also to release the penetrator 12 at target impact with a minimal loss of kinetic energy. Such mouthing structures may include circular clamps or pads, one of which being illustrated as element 33.

The munition may further include a guidance and control unit 40 including an onboard computer and navigation system. The guidance and control unit 40 may further include sensors, such as accelerometers, to detect the lateral acceleration of the munition. Control vanes, such as nose wings 42 and tail fins 50, are controllable by the unit 40 to steer the bomb. The munition may further comprise a global positioning system (GPS) receiver 44.

According to the present invention, one or more structural components of a munition or munitions system can be formed, at least in part, by a composite material comprising a energetic material dispersed in a metallic binder material. The one or more structural components can be formed in their entirety by the composite material of the present invention. Alternatively, structural components can be formed as hybrid components partially formed of the composite material of the present invention, and partly formed from an unreactive material.

Figure 2:
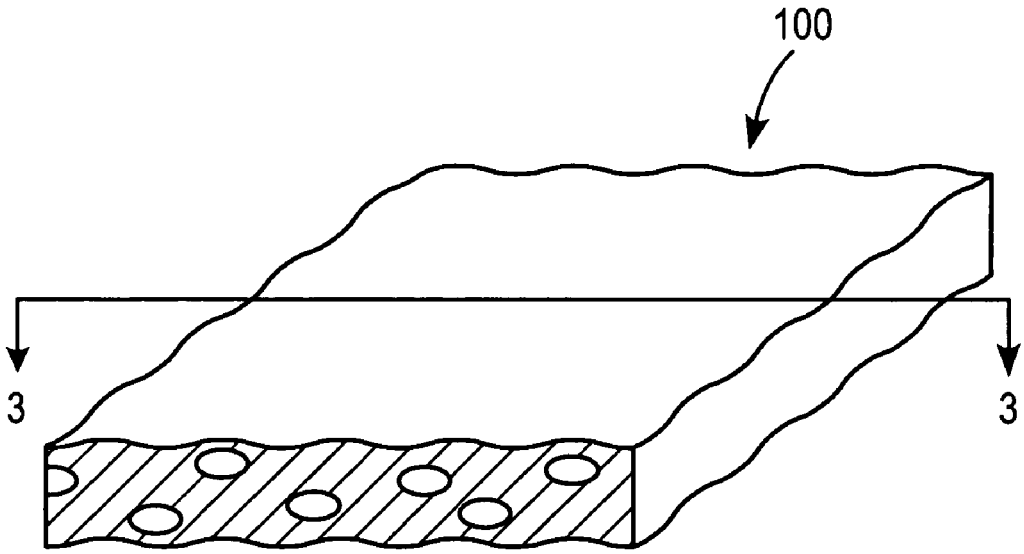
FIG. 2 is a plan view of a random portion of a structural component formed according to the principles of the present invention.

FIG. 2 is a schematic illustration of a representative portion of a structural component 100 of a munition or munitions system formed from a composite material according to the principles of the present invention. The component 100 includes any one, or combination, of any of the structural components described above in connection with the illustration of the munition contained in FIG. 1. However, it should be understood that the component 100 may include other structural components of different weapons and/or weapons systems which have features, functionality, and components, which differ from that of the illustrative embodiment of FIG. 1.

Figure 3:
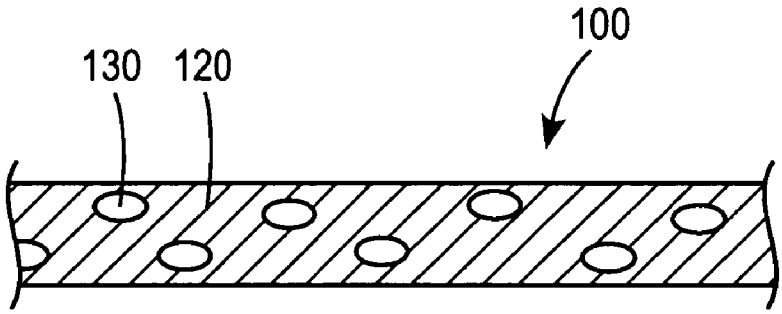
FIG. 3 is a cross-section of the structural component of FIG. 2, taken along line 3-3 of FIG. 2.

As illustrated in FIG. 3, the component 100 generally comprises a metallic binder material 120 having a detonable energetic material 130 dispersed therein.

The binder material 120 can be formed from any suitable metal or combination of metals and/or alloys. According to one embodiment, the binder material 120 comprises a metal or alloy that when combined with the reactive component (or components), the pressure used to compact and densify the structure is of magnitude below that causing auto ignition of the reactive materials. According to a further embodiment, the binder material 120 comprises one or more of: bismuth, lead, tin, aluminum, magnesium, titanium, gallium, indium, and alloys thereof. By way of non-limiting example, suitable binder alloys include (percentages are by mass): 52.2% In/45% Sn/1.8% Zn; 58% Bi/42% Sn; 60% Sn/40% Bi; 95% Bi/5% Sn; 55% Ge; 45% Al; 88.3% Al/11.7% Si; 92.5% Al/7.5% Si; and 95% Al/5% Is. In addition, the binder material 120 may optionally include one or more reinforcing elements or additives. Thus, the binder material 120 may optionally include one or more of: an organic material, an inorganic material, a metastable intermolecular compound, and/or a hydride. By way of non-limiting example, one suitable additive could be a polymeric material that releases a gas upon thermal decomposition. The composite can also be reinforced by adding one or more of the following organic and/or inorganic reinforcements: continuous fibers, chopped fibers, whiskers, filaments, a structural preform, a woven fibrous material, a dispersed particulate, or a nonwoven fibrous material. Other suitable reinforcements are contemplated.

The binder material 120 of the present invention may be provided with any suitable density. For example, the binder material 120 of the present invention may be provided with the density of at least about 10.0 g/cm$^3$. According to a further embodiment, the binder material 120 of the present invention is provided with a density of about 1.7 g/cm$^3$ to about 14.0 g/cm$^3$.

Component 100 may contain any suitable energetic material 130, which is dispersed within the metallic binder material 120. The volumetric proportion of metal binder with respect to reactive materials may be in the range of 20 to 80%, with the remainder of the fragment being comprised of reactive materials. The detonable energetic material 130 may have any suitable morphology (i.e., powder, flake, crystal, etc.) or composition.

The energetic material 130 may comprise a material, or combination of materials, which upon reaction, release enthalpic or work-producing energy. One example of such a reaction is called a "thermite" reaction. Such reactions can be generally characterized as a reaction between a metal oxide and a reducing metal which upon reaction produces a metal, a different oxide, and energy. There are numerous possible metal oxide and reducing metals which can be utilized to form such reaction products. Suitable combinations include but are not limited to, mixtures of aluminum and copper oxide, aluminum and tungsten oxide, magnesium hydride and copper oxide, magnesium hydride and tungsten oxide, tantalum and copper oxide, titanium hydride and copper oxide, and thin films of aluminum and copper oxide. A generalized formula for the stoichiometry of this reaction can be represented as follows:

$$M_xO_y+M_z=M_x+M_zO_y+\text{Energy}$$

wherein $M_xO_y$ is any of several possible metal oxides, $M_z$ is any of several possible reducing metals, $M_x$ is the metal liberated from the original metal oxide, and $M_zO_y$ is a new metal oxide formed by the reaction. Thus, according to the principles of the present invention, the energetic material 130 may comprise any suitable combination of metal oxide and reducing metal which as described above. For purposes of illustration, suitable metal oxides include: $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O5$, $SnO_2$, $WO_2$, $WO_3$, $Fe_3O_4$, $MoO_3$, NiO, CoO, $Co_3O_4$, $Sb_2O_3$, PbO, $Fe_2O_3$, $Bi_2O_3$, $MnO_2$ $Cu_2O$, and CuO. For purposes of illustration, suitable reducing metals include: Al, Zr, Th, Ca, Mg, U, B, Ce, Be, Ti, Ta, Hf, and La. The reducing metal may also be in the form of an alloy or intermetallic compound of the above. For purposes of illustration, the metal oxide is an oxide of a transition metal. According to another example, the metal oxide is a copper or tungsten oxide. According to another alternative example, the reducing metal comprises aluminum or an aluminum-containing compound.

As noted above, the energetic material components 100 may have any suitable morphology. Thus, the energetic material 130 may comprise a mixture of fine powders or one or more of the above-mentioned metal oxides and one or more of the reducing metals. This mixture of powders may be dispersed in the metal binder 120. According to certain embodiments, the metal binder 120 acts as a partial or complete source of metal fuel for the energetic, or thermite, reaction.

Figure 4:
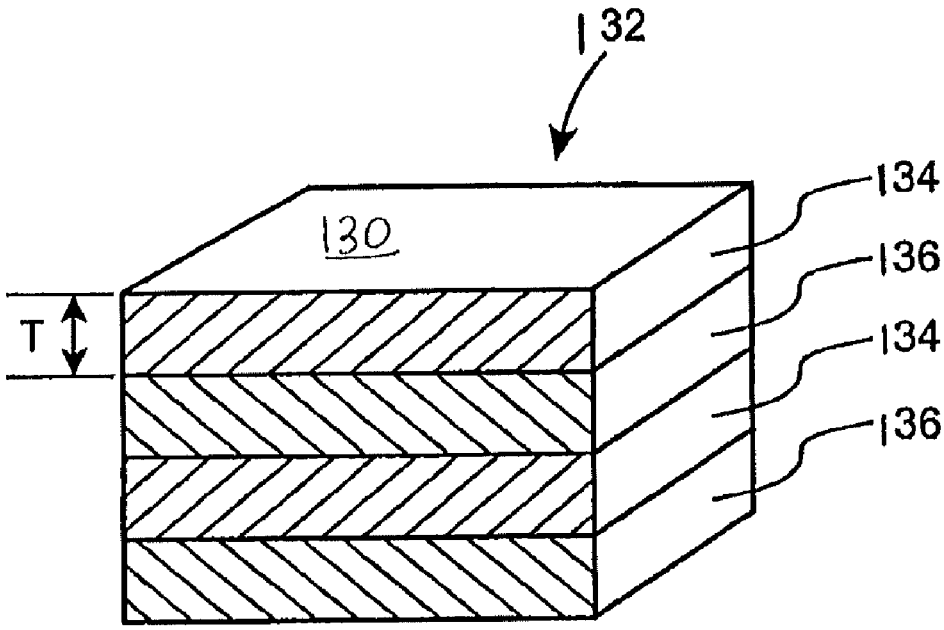
FIG. 4 is a schematic cross-section of a detonable energetic material formed according to the principles of the present invention.

Alternatively, as schematically illustrated in FIG. 4, the energetic material 130 may be in the form of a thin film 132 having at least one layer of any of the aforementioned reducing metals 134 and at least one layer of any of the aforementioned metal oxides 136. The thickness T of the alternating layers can vary, and can be selected to impart desirable properties to the energetic material 130. For purposes of illustration, the thickness T of layers 134 and 136 can be about 10 to about 1000 nm. The layers 134 and 136 may be formed by any suitable technique, such as chemical or physical deposition, vacuum deposition, sputtering (e.g., magnetron sputtering), or any other suitable thin film deposition technique. Each layer of reducing metal 134 present in the thin-film can be formed from the same metal. Alternatively, the various layers of reducing metal 134 can be composed of different metals, thereby producing a multilayer structure having a plurality of different reducing metals contained therein. Similarly, each layer of metal oxide 136 can be formed from the same metal oxide. Alternatively, the various layers of metal oxide 136 can be composed of different oxides, thereby producing a multilayer structure having different metal oxides contained therein. The ability to vary the composition of the reducing metals and/or metal oxides contained in the thin-film structure advantageously increases the ability to tailor the properties of the detonable energetic material 130, and thus the properties of the structural component 100.

The structural component 100 of the present invention can be formed according to any suitable method or technique.

Generally speaking, a suitable method for forming a structural component of the present invention includes forming an energetic material, combining the energetic material with a metallic binder material to form a mixture, and shaping the combined energetic material and metallic binder material mixture to form a composite structural component.

The energetic material can be formed according to any suitable method or technique. For example, when the energetic material is in the form of a thin film, as mentioned above, the thin-film detonable energetic material can be formed as follows. The alternating layers of oxide and reducing metal are deposited on a substrate using a suitable technique, such as vacuum vapor deposition or magnetron sputtering. Other techniques include mechanical rolling and ball milling to produce layered structures that are structurally similar to those produce in vacuum deposition. The deposition or fabrication processes are controlled to provide the desired layer thickness, typically on the order of about 10 to about 1000 nm. The thin-film comprising the above-mentioned alternating layers is then removed form the substrate. Removable can be accomplished by a number of suitable techniques such as photoresist coated substrate lift-off, preferential dissolution of coated substrates, and thermal stock of coating and substrate to cause film delamination. According to one embodiment, the inherent strain at the interface between the substrate and the deposited thin film is such that the thin-film will flake off the substrate with minimal or no effort.

The removed layered material is then reduced in size; preferably, in a manner such that the pieces of thin-film having a reduced size are also substantially uniform. A number of suitable techniques can be utilized to accomplish this. For example, the pieces of thin-film removed from a substrate can be worked to pass them through a screen having a desired mesh size. By way of non-limiting example, a 25-60 size mesh screen can be utilized for this purpose. This accomplishes both objectives of reducing the size of the pieces of thin-film removed from the substrate, and rendering the size of these pieces substantially uniform.

The above-mentioned reduced-size pieces of thin layered film are then combined with metallic matrix or binder material to form a mixture. The metallic binder material can be selected from many of the above-mentioned binder materials. This combination can be accomplished by any suitable technique, such as milling or blending. Additives or additional components can be added to the mixture. As noted above, such additives or additional components may comprise one or more of: an organic material, and inorganic material, a metastable intermolecular compound, and/or a hydride In addition, one or more reinforcements may also be added. Such reinforcements may include organic and/or inorganic materials in the form of one or more of: continuous fibers, chopped fibers, whiskers, filaments, a structural preform, dispersed particulate, a woven fibrous material, or a nonwoven fibrous material. Optionally, the pieces of layered film, the metallic binder material, the above-mentioned additives and/or the above-mentioned reinforcements can be treated in a manner that functionalizes the surface(s) thereof, thereby promoting wetting of the pieces of thin-film in the matrix of metallic binder. Such treatments are per se known in the art. For example, the particles can be coated with a material that imparts a favorable surface energy thereto.

This mixture can then be shaped thereby forming a structural component having a desired geometrical configuration. The structural component can be shaped by any suitable technique, such as molding or casting, pressing, forging, cold isostatic pressing, hot isostatic pressing. As noted above, the structural component can be provided with any suitable geometry As explained above, there are number of potential applications for a structural components according to principles of the present invention. Non-limiting exemplary weapons and/or weapons systems which may incorporate composite structural components formed according to the principles of the present invention include a BLU-109 warhead or other munition such as BLU-109/B, BLU-113, BLU-116, JASSM-1000, J-1000, and the JAST-1000.

Figure 5:
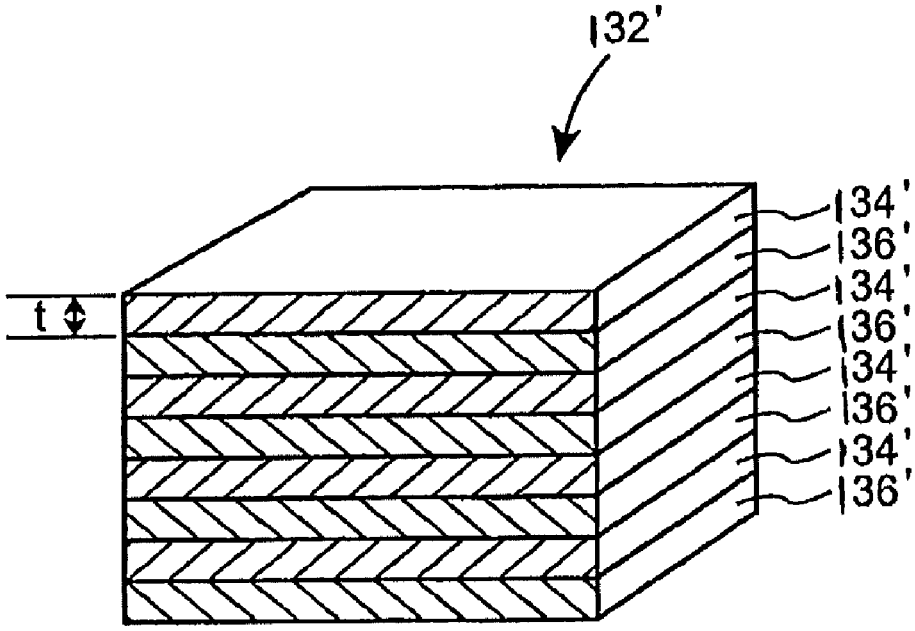
FIG. 5 is a schematic cross-section of a detonable energetic material formed according to an alternative embodiment of the present invention.

One advantage of a structural component formed according to principles of the present invention is that both the composition and/or morphology of the reactive material 130 can be used to tailor the sensitivity of the reactive structural component to impact forces. While the total chemical energy content of the reactive material is primarily a function of the quantity of the reducing metal and metal oxide constituents, the rate at which that energy is released is a function of the arrangement of the reducing metal and metal oxide relative to one another. For instance, the greater the degree of mixing between the reducing metal and metal oxide components of the energetic material, the quicker the reaction that releases thermal energy will proceed. Consider the embodiment of the thin-film 132' depicted in FIG. 5 compared with the embodiment of the thin film 132 depicted in FIG. 4. The layers of reducing metal 134' and metal oxide 136' contained in the thin-film 132' have a thickness t which is less than that of the thickness T of the layers in thin-film 132 (T>t). Otherwise, volume of the thin films 132 and 132' are the same. Thus, the total mass of reducing metal and the total mass of metal oxide contained in the two thin films are likewise the same. As a result, the total thermal energy released by the two films should be approximately the same. However, it is evident that the reducing metal and metal oxide are intermixed to a greater degree in the thin-film 132'. The thermal energy released by the thin-film 132' will proceed at a faster rate than the release of thermal energy from the thin-film 132. Thus, the timing of the release of thermal energy from a thin-film formed according to the principles of the present invention can be controlled to a certain extent by altering the thickness of the layers of reducing metal and metal oxide contained therein.

Similarly, the timing of the release of chemical energy from a thin-film formed according to the principles of the present invention can also be controlled, at least to some degree, by the selection of materials, and their location, within a thin-film. For example, in the thin-film 132' depicted in FIG. 5, the rate at which thermal energy is released can be altered by placing layers of metal oxide and/or reducing metal which have a greater reactivity toward the interior of the thin film 132', while positioning reducing metal and four/or metal oxide layers having a lower reactivity on the periphery (i.e. top and bottom). Since those layers located on the periphery of the thin-film 132' are presumably more'susceptible to ignition due to their proximity to outside forces, these layers will begin to release thermal energy prior to those layers contained on the interior. By placing less reactive materials on the periphery, the overall reaction rate of the thin-film 132 can be slowed.

Other advantages provided by the present invention can be attributed to the use of a metallic binder material 120, of the type described herein, in the formation of a structural component. First, the structural component can be provided with an increased density relative to structural components made from conventional materials. This increased density enhances the ballistic effects of the fragment on the target by imparting more kinetic energy thereto. The metallic binder material also may increase the structural integrity of the structural component thereby enhancing the same ballistic effects. This increased structural integrity also may enhance the ability of the structural component to withstand the shock loadings encountered during firing of the munition.

Still other advantages can be attained from the structural components of the present invention. During the blast, particles of the metallic binder material will likely exhibit a desirable nonideal gas-like behavior due to its high density, large molecular weight and heat transfer rates. Namely, momentum effects of the blast likely results in the particles of the metallic binder material lagging in velocity behind the lighter weight gas explosive products such as CO, $CO_2$, $N_2$, and $H_2O$ vapor, Similarly, heat transfer effects on the particles of the metallic binder material also lag behind. This desirable non-ideal behavior suggests that the sharpness of an overpressure peak during the initial will be somewhat attenuated due to thermal and kinetic energy storage of released binder particles. As the blast progresses, release of the kinetic and thermal energy stored by the particles of the metallic binder material will ideally result in an extension of the time at overpressure, thereby enhancing damage to the target. Many metallic binder materials, such as those discussed above, have relatively strong thermodynamic tendencies to react with oxygen in the air. Thus, particles of metallic binder material may impart a significant after burning component to the blast, further extending the overpressure in the time domain and the release of energy into the target. Any metallic binder material which is not consumed by after burning can be readily distributed into the target as a result of a successful reactive fragment impacts, thus increasing the likelihood of electrical short-circuiting if electrical components are housed within the target.

All numbers expressing quantities of ingredients, constituents, reaction conditions, and so forth used in the specification are to be understood as being modified in all instances by the term "about". Notwithstanding that the numerical ranges and parameters setting forth, the broad scope of the subject matter presented herein are approximations, the, numerical values set forth are indicated as precisely as possible. Any numerical value, however, inherently contains certain errors necessarily resulting from the standard deviation found in their respective measurement techniques.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A munition comprising:

a structural component formed from a composite material comprising a energetic material dispersed in a metallic binder material, wherein the energetic material comprises a combination of metal oxide and reducing metal in the form of a thin film having at least one layer formed of the metal oxide and at least one layer formed of the reducing metal.

2. The munition of claim 1, wherein the structural component comprises a warhead casing.

3. The munition of claim 1, wherein the metallic binder has a density of about 1.0 to about 17.0 g/cm$^3$.

4. The munition of claim 3, wherein the metallic binder has a density of at least 7.5 g/cm$^3$.

5. The munition of claim 1, wherein the metallic binder material comprises one or more of bismuth, lead, tin, indium, and alloys thereof.

6. The munition of claim 1; wherein the energetic material is in the form of particles having a substantially uniform size.

7. The munition of claim 6, wherein the particles are sized such that the particles will pass through a 25-60 size mesh screen.

8. The munition of claim 1, wherein the layers have a thickness of about 10 to about 10000 nm.

9. The munition of claim 1, wherein the composite additionally comprises one or more of: an organic material, and inorganic material, a metastable intermolecular composite, or a hydride.

10. The munition of claim 1, wherein the composite is reinforced with one or more reinforcements comprising organic or inorganic materials in the form of: chopped fibers, whiskers, a structural preform, a woven fibrous material, a nonwoven fibrous material, or a dispersed particulate.

11. The munition of claim 10, wherein at least one of the energetic material, the metallic binder material, and the one or more reinforcements are surface treated to promote wetting.

12. The munition of claim 1, wherein the munition comprises a warhead, the warhead comprising a penetrator casing formed at least in part from the composite.

* * * * *